US009955267B1

(12) United States Patent
Hui et al.

(10) Patent No.: US 9,955,267 B1
(45) Date of Patent: Apr. 24, 2018

(54) FILM SPEAKER

(71) Applicants: Yao Hui, Shenzhen (CN); Shujuan Li, Shenzhen (CN)

(72) Inventors: Yao Hui, Shenzhen (CN); Shujuan Li, Shenzhen (CN)

(73) Assignee: AAC TECHNOLOGIES PTE, LTD., Singapore (SG)

( * ) Notice: Subject to any disclaimer, the term of this patent is extended or adjusted under 35 U.S.C. 154(b) by 0 days.

(21) Appl. No.: 15/415,925

(22) Filed: Jan. 26, 2017

(30) Foreign Application Priority Data

Oct. 26, 2016 (CN) ..... 2016 2 1173726 U

(51) Int. Cl.

| | |
|---|---|
| ***H04R 9/06*** | (2006.01) |
| ***H04R 7/26*** | (2006.01) |
| ***H04R 9/04*** | (2006.01) |
| ***H04R 1/24*** | (2006.01) |
| ***H04R 7/18*** | (2006.01) |
| ***H04R 7/06*** | (2006.01) |
| ***H04R 9/02*** | (2006.01) |

(52) U.S. Cl.
CPC ..... *H04R 9/06* (2013.01); *H04R 1/24* (2013.01); *H04R 7/06* (2013.01); *H04R 7/18* (2013.01); *H04R 7/26* (2013.01); *H04R 9/025* (2013.01); *H04R 9/046* (2013.01)

(58) Field of Classification Search
CPC ... H04R 2440/00–2440/07; H04R 1/08; H04R 9/08; H04R 11/04; H04R 17/02; H04R 21/02; H04R 2217/00–2217/03; H04R 19/00; H04R 19/01; H04R 19/013; H04R 19/016; H04R 9/048; H04R 7/04
USPC ..... 381/152, 171, 173, 176, 177, 190–191, 381/399, 431
See application file for complete search history.

(56) References Cited

U.S. PATENT DOCUMENTS

| | | | | | |
|---|---|---|---|---|---|
| 4,182,937 | A * | 1/1980 | Greenwood | H04R 17/02 | 257/418 |
| 4,461,933 | A * | 7/1984 | Chave | H04R 9/041 | 335/209 |
| 4,471,173 | A * | 9/1984 | Winey | H04R 9/047 | 181/170 |
| 5,487,114 | A * | 1/1996 | Dinh | H04R 9/00 | 381/406 |
| 6,108,433 | A * | 8/2000 | Norris | G10K 9/13 | 367/140 |
| 8,144,918 | B2 * | 3/2012 | Ikeda | H04R 7/045 | 381/152 |

(Continued)

*Primary Examiner* — Suhan Ni
(74) *Attorney, Agent, or Firm* — Na Xu; IPro, PLLC

(57) ABSTRACT

A film speaker includes a metal foil; a diaphragm apart from and opposed to the metal foil, an elastomer for supporting the diaphragm, and a voice coil disposed on the metal foil for producing magnetic field. The diaphragm includes a number of diaphragms. The elastomer includes a main body and a number of partition portions for dividing the elastomer into a number of vibration areas, each of the vibration areas corresponding to one of the number of diaphragms. The voice coil includes a number of voice coils corresponding to the vibration areas. Each of the diaphragms includes a substrate layer and a magnetic material layer attached to a surface of the substrate layer for interacting with the magnetic field produced by the voice coils so as to drive the diaphragms to vibrate for generating sound.

9 Claims, 6 Drawing Sheets

(56) References Cited

U.S. PATENT DOCUMENTS

| | | | | |
|---|---|---|---|---|
| 8,705,774 | B2 * | 4/2014 | Jilani | H04R 17/02<br>381/152 |
| 2007/0263886 | A1 * | 11/2007 | Starnes | H04R 17/10<br>381/190 |

* cited by examiner

FILM SPEAKER

FIELD OF THE PRESENT DISCLOSURE

The present disclosure relates to the technical field of electroacoustic transducers, and more particularly to a film speaker.

DESCRIPTION OF RELATED ART

Speakers are widely applied in people's daily life as a sound generator of electronic equipment. People are generally in pursuit of light and thin appearance design for smart products such as smart phones, smart watches, smart bands and tablets or notebook computers, so limited space is left for speakers.

In the related art, a moving-coil speaker is generally adopted in consumer electronic products, and common moving-coil speakers make a sound mainly through vibration of a diaphragm which is caused by the electromagnetic induction produced by a voice coil and a magnetic circuit system, with the operating principle that inserted in the magnetic gap formed by the magnetic circuit system, the voice coil produces electromagnetic induction with the magnetic circuit system as current passes through it, so that the voice coil makes reciprocating motion and drives the diaphragm to make reciprocating motion. In common moving-coil speakers, the magnetic circuit system occupies large space, and in order to enable the voice coil to drive the diaphragm to vibrate, adequate space must be provided for the voice coil to make reciprocating motion, so the thickness of the whole body is increased, not help to meet the demand for lighter and thinner consumer electronic products.

Thereof, it is necessary to disclose and provide an improved film speaker to overcome the above-mentioned disadvantages.

BRIEF DESCRIPTION OF THE DRAWINGS

Many aspects of the exemplary embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENTS

The present disclosure will hereinafter be described in detail with reference to several exemplary embodiments. To make the technical problems to be solved, technical solutions and beneficial effects of the present disclosure more apparent, the present disclosure is described in further detail together with the figures and the embodiments. It should be understood the specific embodiments described hereby are only to explain this disclosure, not intended to limit this disclosure.

Figure 1:
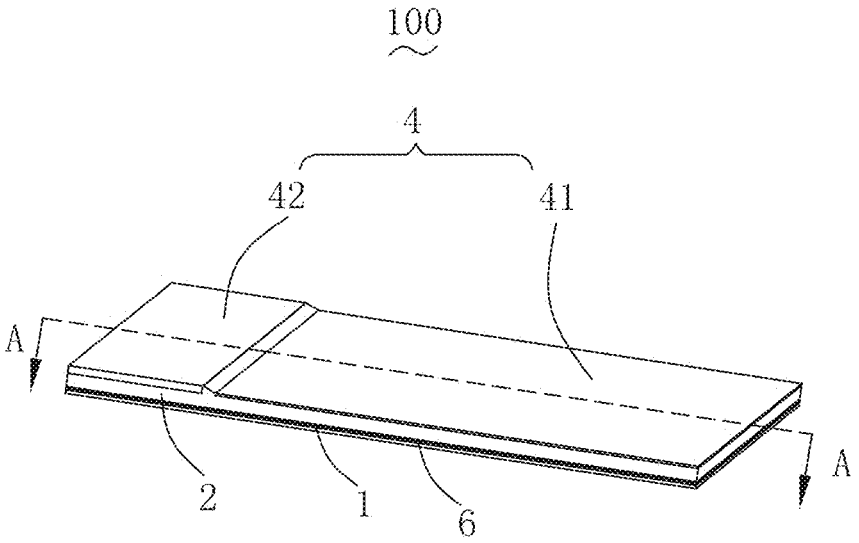
FIG. 1 is an isometric view of a film speaker in accordance with an exemplary embodiment of the present disclosure.
Figure 2:
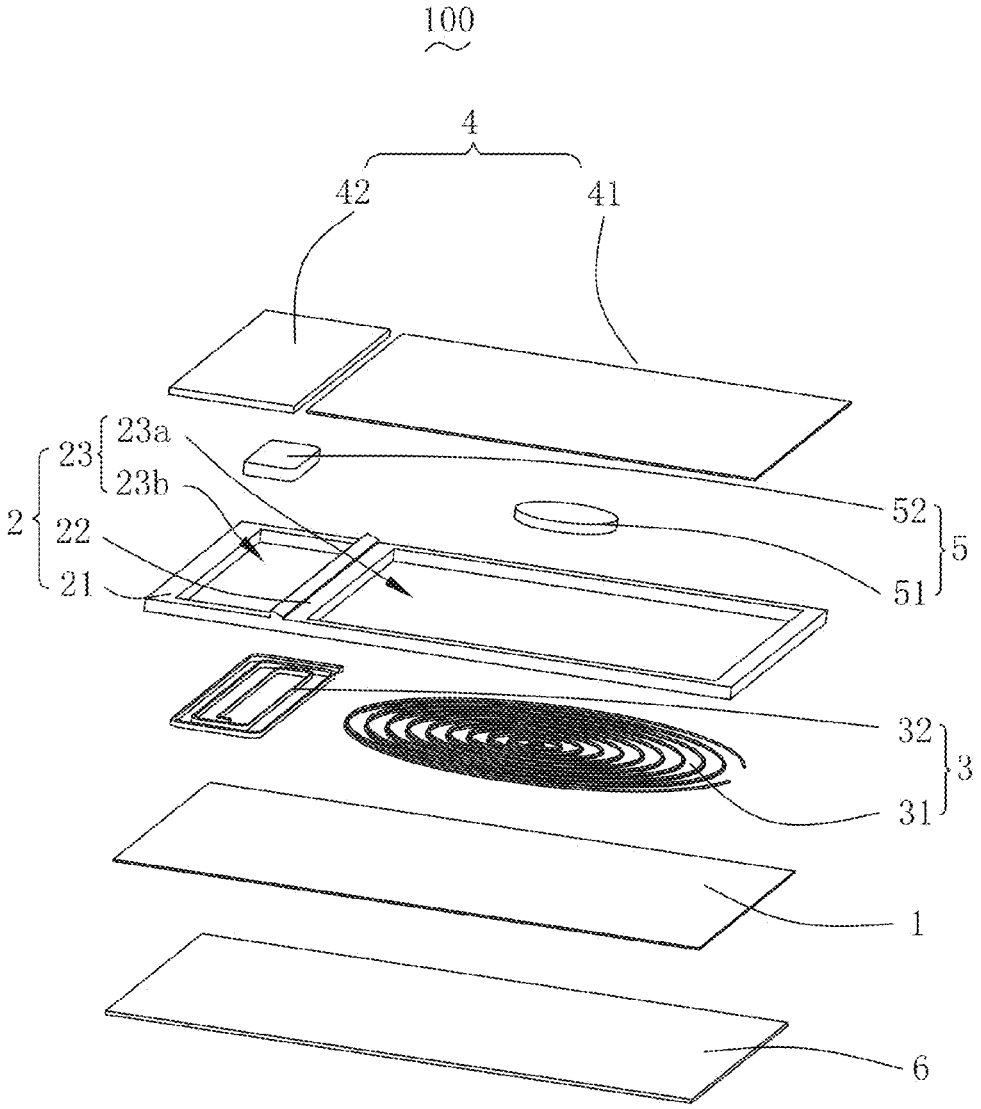
FIG. 2 is an exploded view of the film speaker in FIG. 1.
Figure 3:
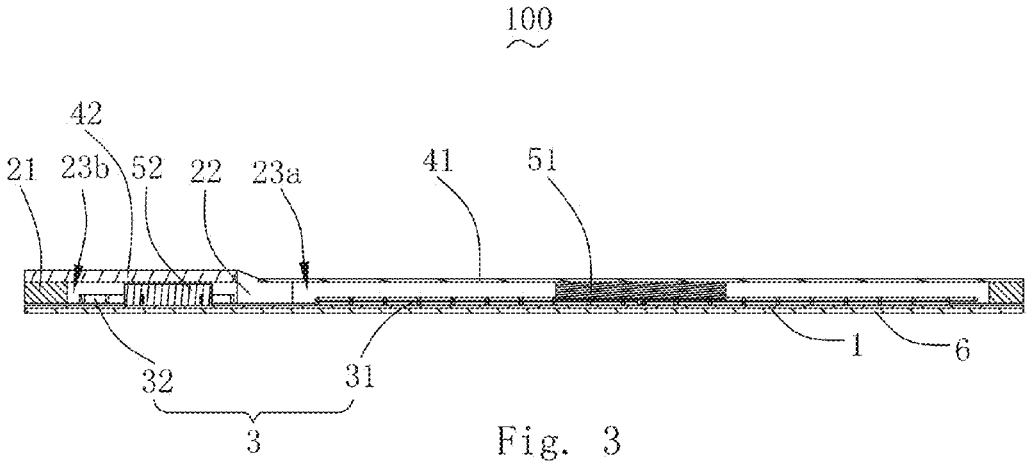
FIG. 3 is a cross-sectional view of the film speaker, taken along Line A-A in FIG. 1.

Referring to FIGS. 1-3, a film speaker 100 in accordance with an exemplary embodiment of the present disclosure comprises a metal foil 1, an elastomer 2, a voice coil 3, a diaphragm 4, a damping member 5 and a supporting plate 6. The supporting plate 6, the metal foil 1, the elastomer 2 and the diaphragm 4 enclose to form an accommodation space for accommodating the voice coil 3 and the damping member 5.

The metal foil 1 is formed on the surface of the supporting plate 6, and in this embodiment, the metal foil is an iron foil. The purity of the metal foil is up to 99.99%, because high-purity metal foils have better flexibility in control of magnetic fields.

The elastomer 2 is connected with the diaphragm 4 for supporting the diaphragm 4 away from the metal foil 1. The elastomer 2 comprises a main body 21 and a partition part 22. The partition part 22 is connected with the circular main body 21 and disposed inside an area enclosed by the circular main body 21 for dividing the area into at least two vibration areas 23.

In this embodiment, the vibration areas 23 include a low-frequency area 23*a* and a high-frequency area 23*b* according to the working frequency band.

The elastomer 2 can be made from foam, composite material of constrained damping structure or doped composite material. For low-frequency speaker, the elastomer 2 can be made from foam, so that it can not only adjust the vibration elasticity of the generating plane, but also increase the overall flexibility of the film speaker 100 to better play its advantage of flexibility; for low and high-frequency speaker, the elastomer 2 can be made from composite material of constrained damping structure or doped composite material (such as thermoplastic elastomer doped with petroleum resin).

The voice coil 3 is fixed on the metal foil 1 and is a flat voice coil, molded through conductive ink printing process, sheet metal punching process, chemical etching process, laser engraving process, laser plated metal layer process or plane winding. In this embodiment, the voice coil 3 includes a first voice coil 31 and a second voice coil 32, respectively arranged at the low-frequency area 23*a* and the high-frequency area 23*b* correspondingly.

Figure 4:
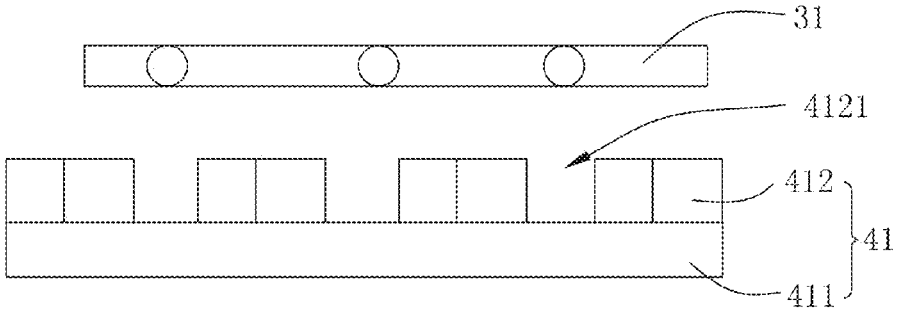
FIG. 4 is an illustration showing the relationship of a diaphragm and a voice coil of the film speaker.

Referring to FIG. 4, the diaphragms 4 includes a first diaphragm 41 and a second diaphragm 42, respectively arranged at the low-frequency area 23*a* and the high-frequency area 23*b* correspondingly. The first diaphragm 41 and the second diaphragm 42 are respectively connected with the elastomer 2, and arranged oppositely spaced apart from the metal foil 1, the first voice coil 31, the second voice coil 32 generate magnetic field after being electrified, and drive the corresponding first diaphragm 41 and second diaphragm 41 to make reciprocating motion. When the diaphragm 4 vibrates, the volume of the air cavity increases or decreases, which produces pressure difference between the inside and the outside for producing a restoring force to the diaphragm.

The first diaphragm 41 comprises a substrate layer 411 and a magnetic material layer 412 formed on the surface of the substrate layer 411. The first diaphragm 41 is magnetic and interacts with the magnetic field generated by the voice coil 31.

The substrate layer 411 can be flexible substrate film or stiff substrate film, wherein the flexible substrate film is a PEK polymer layer; the stiff substrate film is a thin layer of metal, oxide or alloy.

The magnetic material layer 412 is a metal magnetic material layer, and may be made from a mixture of multiple elements such as iron, Neodymium, boron, cobalt, its compounding ratio can be adjusted according to actual design demand.

The magnetic material layer 412 is arranged oppositely spaced apart from the first voice coil 31, and has a plurality of magnetic gaps 4121. A projection of the first voice coil 3 on the magnetic material layer 412 along a vibration direction is located in the magnetic gaps 4121, so as to improve the efficiency of vibration of the first diaphragm 41 being driven by the first voice coil 3. The structure of the second diaphragm 42 is the same as that of the first diaphragm 41 described above.

The diaphragm 4 is injection-molded integrally with the elastomer 2, so as to injection-mould the diaphragms 4 of different frequency band into an integrity to be assembled with a driving end, thus facilitating assembly.

The thickness of the diaphragm 4 can be designed according to the corresponding frequency band, for the relatively low amplitude requirement of the high-frequency area 23*b*, when the thickness of the second diaphragm 42 is larger than that of the first diaphragm 41, it allows to inhibit the partition vibration in work effectively and thus improve the performance of the film speaker 100.

The damping member 5 is arranged between the voice coil 3 and the diaphragm 4, with each end thereof abutting against the voice coil 3 and the diaphragm 4 respectively. The damping member 5 includes a first damping member 51 and a second damping member 52, respectively arranged at the low-frequency area 23*a* and the high-frequency area 23*b* correspondingly. The first damping member 51, the second damping member 52 are respectively located at the center position of the first voice coil 31 and the second voice coil 32, so as to provide better damping effect.

The damping material can be foam and the damping member 5 has a compression ratio of 10%-80% at vibration condition. Polyester foam, elastomer foam or silica gel foam can be selected to be used for the damping member 5, foam of other material can also be alternatively used. Damping member 5 has a certain compression ratio at vibration condition.

Figure 5:
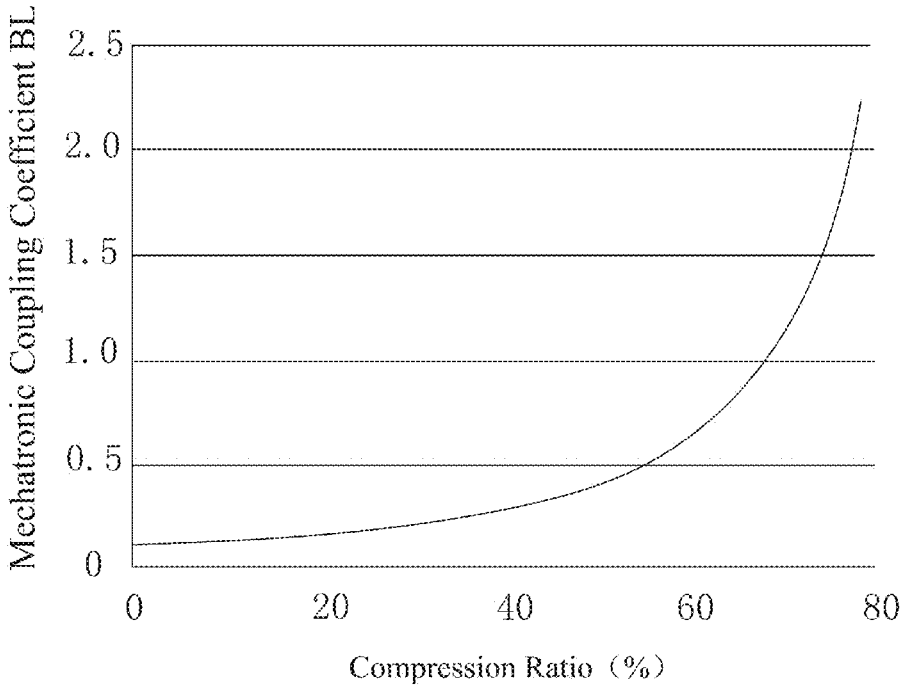
FIG. 5 shows a relationship between a compression ratio and a mechatronic coupling coefficient BL of a damping member of the film speaker.
Figure 6:
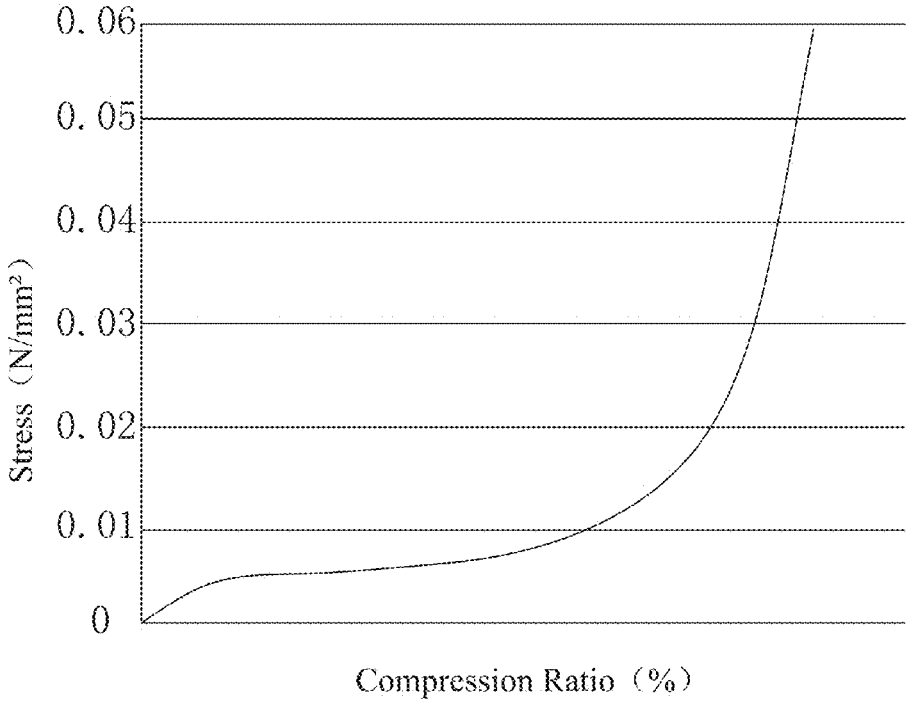
FIG. 6 shows a relation between the compression ratio and a stress of the damping member in the film speaker.

Referring to FIGS. 5-6, when the compression ratio of the foam is in the range of 10-80%, the mechatronic coupling coefficient BL of the film speaker 100 increases with the increase in compression ratio, and the stress upon the foam also increase with it; and under different conditions of compression ratio, the ratio of mechatronic coupling coefficient BL and the stress is a fixed value, so that the vibration stiffness of the film speaker 100 and BL value can be coordinated with the change in amplitude, thus ensuring the vibration linearity to control distortion of the film speaker effectively.

Figure 7:
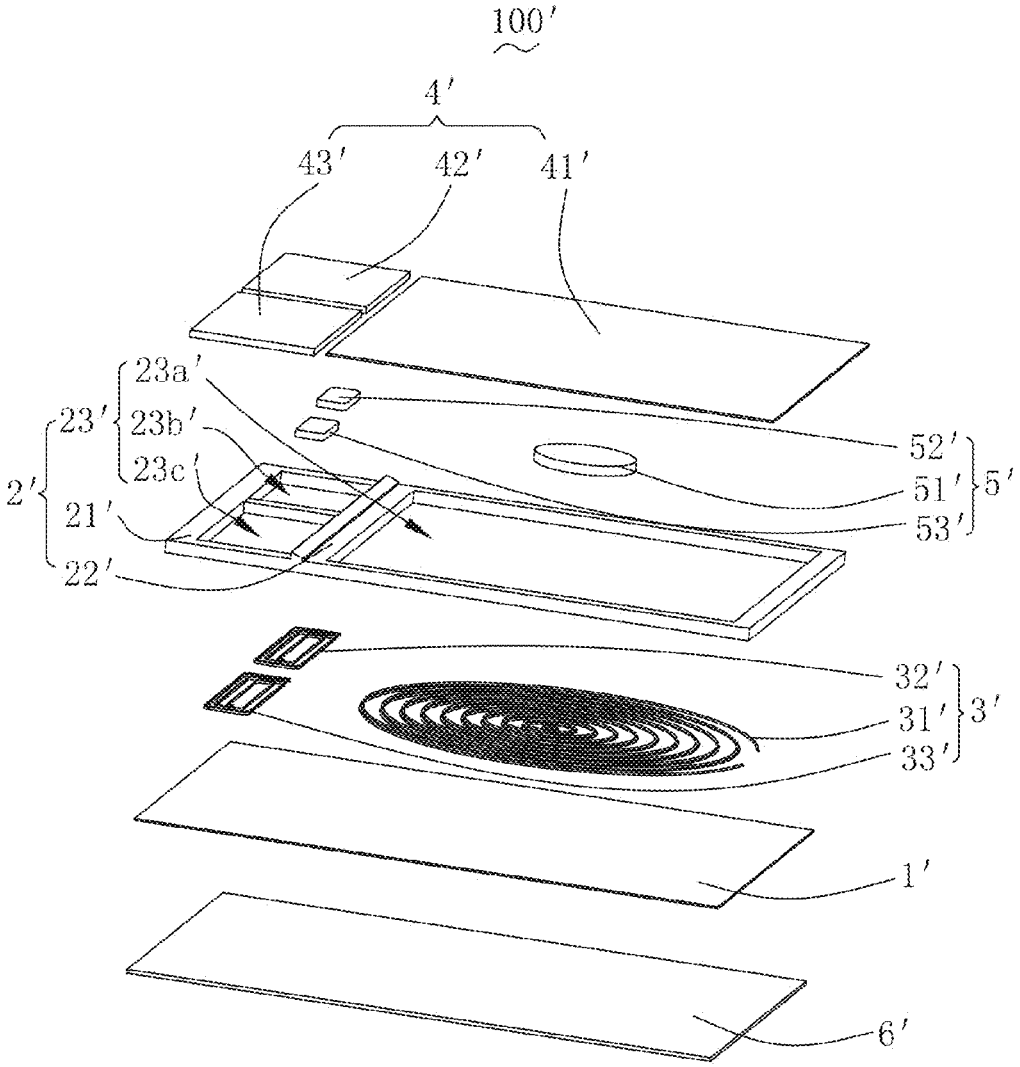
FIG. 7 is an exploded view of a film speaker in accordance with another exemplary embodiment of the present disclosure.

Referring to FIG. 7, a film speaker 100' in accordance with another exemplary embodiment of the present disclosure comprises an metal foil 1', an elastomer 2', a voice coil 3', a diaphragm 4', a damping member 5' and a supporting plate 6'.

The installation locations and structures of all the components in the metal foil 1', elastomer 2', voice coil 3', diaphragm 4', damping member 5' and supporting plate 6' are the same as those in the previous embodiment. The differences are that:

The elastomer 2' comprises a main body 21' and a partition part 22', the partition part 22' divides an area formed by the main body 21' into multiple vibration areas 23' at least including a low-frequency area 23*a'*, a high-frequency area 23*b'* and an intermediate-frequency area 23*c'*.

Correspondingly, the voice coils 3 includes a first voice coil 31', a second voice coil 32' and a third voice coil 33' respectively arranged at the low-frequency area 23*a'*, the high-frequency area 23*b'* and the intermediate-frequency area 23*c'* correspondingly.

The diaphragms 4 includes a first diaphragm 41', a second diaphragm 42' and a third diaphragm 43' respectively arranged at the low-frequency area 23*a'*, the high-frequency area 23*b'* and the intermediate-frequency area 23*c'* correspondingly. The thickness of the diaphragm 4' varies, that of the second diaphragm 42' is larger than that of the third diaphragm 43', and that of the second diaphragm 43' is larger than that of the third diaphragm 41'.

The damping member 5' includes a first damping member 51', a second diaphragm 52' and a third damping member 53' respectively arranged at the low-frequency area 23*a'*, the high-frequency area 23*b'* and the intermediate-frequency area 23*c'* correspondingly.

Besides the above two embodiments, the elastomer can also divide the vibration area into combinations of intermediate-frequency area and low-frequency area or combinations of intermediate-frequency area and high-frequency area.

The speaker disclosed in the present utility model has the following beneficial effects compared with the related art:

I. The voice coil generate a magnetic field after being electrified, the metal foil is magnetized as soft magnetic material, intensifying the magnetic force of the voice coil and producing gravitation and repulsion to the diaphragm with magnetic material layer to make the diaphragm make reciprocating motion. Therefore, the space occupied by the magnetic circuit system and the voice coil in the related art can be omitted, effectively reducing the thickness of loudspeakers and meeting the design demand of lighter and thinner electronic products.

II. The elastomer divides the film speaker into multiple vibration areas, so as to realize combined use of multiple frequency bands and expand the application range of the film speaker.

III. The elastomer is injection molded, and the diaphragm corresponding to respectively each vibration area is injection molded integrally with the elastomer, so as to injection-mould the diaphragm of different frequency band into an integrity to be assembled with a driving end, thus facilitating assembly.

IV. The film speaker comprises a damping member which is arranged between the voice coil and the diaphragm with each end abutting on the voice coil and the diaphragm respectively, wherein the damping member has good stiffness adjustment ability, so that the vibration stiffness and BL value can be well coordinated with the change in amplitude, thus controlling distortion of the film speaker effectively.

V. The thickness of the diaphragm corresponding to the intermediate-frequency area, high-frequency area is larger than that corresponding to the low-frequency area, so as to inhibit the partition vibration in work and thus improve the performance of the film speaker.

It is to be understood, however, that even though numerous characteristics and advantages of the present exemplary embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A film speaker, including:

a metal foil;

a diaphragm apart from and opposed to the metal foil, the diaphragm including a plurality of diaphragms;

an elastomer for supporting the diaphragms, the elastomer including a main body and a plurality of partition portions for dividing the elastomer into a plurality of vibration areas, each of the vibration areas corresponding to one of the plurality of diaphragms;

a voice coil disposed on the metal foil for producing magnetic field, the voice coil including a plurality of voice coils corresponding to the vibration areas;

wherein each of the plurality of diaphragms comprises a substrate layer and a magnetic material layer attached to a surface of the substrate layer for interacting with the magnetic field produced by the voice coils so as to drive the plurality of diaphragms to vibrate for generating sound.

2. The film speaker as described in claim 1 further comprising a supporting plate for carrying the metal foil, and the supporting plate forms a sealed accommodation space cooperatively with the diaphragm and the elastomer.

3. The film speaker as described in claim 1 further comprising a plurality of damping members each being sandwiched between the corresponding diaphragm and the corresponding voice coil.

4. The film speaker as described in claim 1, wherein the metal foil is an iron foil.

5. The film speaker as described in claim 3, wherein the damping member has a compression ratio range between 10%~80% under vibration.

6. The film speaker as described in claim 1, wherein the plurality of vibration areas includes at least a high-frequency area and a low-frequency area.

7. The film speaker as described in claim 6, wherein a thickness of the diaphragm corresponding to the high-frequency area is thicker than a thickness of the diaphragm corresponding to the low-frequency area.

8. The film speaker as described in claim 1, wherein the plurality of vibration areas includes at least a high-frequency area, a low-frequency area, and an intermediate-frequency area.

9. The film speaker as described in claim 8, wherein a thickness of the diaphragm corresponding to the high-frequency area is thicker than a thickness of the diaphragm corresponding to the intermediate-frequency area, and the thickness of the diaphragm corresponding to the intermediate-frequency area is thicker than a thickness of the diaphragm corresponding to the low-frequency area.

* * * * *